US005756429A

United States Patent [19]

Ichihashi

[11] Patent Number: 5,756,429

[45] Date of Patent: May 26, 1998

[54] LUBRICATING OIL COMPOSITION FOR HIGH-SPEED GEAR

[75] Inventor: Toshihiko Ichihashi, Ichihara, Japan

[73] Assignee: Idemitsu Kosan Co., Ltd., Tokyo, Japan

[21] Appl. No.: 624,367

[22] PCT Filed: Oct. 5, 1994

[86] PCT No.: PCT/JP94/01662

§ 371 Date: Mar. 28, 1996

§ 102(e) Date: Mar. 28, 1996

[87] PCT Pub. No.: WO95/09904

PCT Pub. Date: Apr. 13, 1995

[30] Foreign Application Priority Data

Oct. 6, 1993 [JP] Japan ..... 5-250266

[51] Int. Cl.[6] ..... C10M 141/10

[52] U.S. Cl. ..... 508/192; 508/295

[58] Field of Search ..... 508/192, 295

[56] References Cited

U.S. PATENT DOCUMENTS 4,812,246 3/1989 Yabe ..... 508/379

5,225,093 7/1993 Campbell et al. ..... 508/287

5,372,703 12/1994 Kamiya et al. ..... 208/58

5,605,880 2/1997 Arai ..... 508/443

*Primary Examiner*—Jerry D. Johnson

*Attorney, Agent, or Firm*—Antonelli, Terry, Stout & Kraus, LLP

[57] ABSTRACT

A lubricating oil composition for a high-speed gear particularly having a peripheral speed of 10 m/sec or more is herein disclosed which is obtained by blending a base oil having a % $C_A$ of 5 or less and preferably further having a nitrogen content of 50 ppm or less and a sulfur content of 50 ppm or less with a sulfur additive, a phosphorus additive and a nitrogen additive so that an element ratio 100N/(S+P) in the composition may be in the range of 4 to 10 by weight, and the lubricating oil composition has a sufficient hypoid gear performance, can inhibit the formation of a sludge, and permits the prolongation of the life of an oil seal for use in a high-speed and/or a high-temperature rotating portion.

19 Claims, No Drawings

LUBRICATING OIL COMPOSITION FOR HIGH-SPEED GEAR

DESCRIPTION

1. Technical Field

The present invention relates to a lubricating oil composition for a high-speed gear. More specifically, it relates to a lubricating oil composition which has a sufficient hypoid gear performance (extreme-pressure properties), can inhibit the formation of a sludge, can particularly be used as a gear oil for a transmission equipped with a high-speed rotating shaft having a peripheral speed of 10 m/sec or more, and is also useful as a gear oil for a superhigh-speed transmission having a peripheral speed of more than 20 m/sec.

2. Background Art

Heretofore, as a gear oil for vehicles, a sulfur-phosphorus extreme-pressure additive blending oil has usually been used. However, when such a sulfur-phosphorus extreme-pressure additive blending oil is used for a transmission having a peripheral speed of more than 10 m/sec, a seal portion is locally heated, so that a sludge is formed and a trouble such as a damage to a seal lip portion often occurs. Therefore, for the high-speed rotating shaft, a non-contact seal mechanism has been used and slight oil leakage has unavoidably been allowed, or measures have been taken by the replacement of the oil at an early stage.

Thus, it has been desired to develop a lubricating oil for a high-speed gear which has sufficient extreme-pressure properties and can inhibit the formation of the sludge [an n-pentane-insoluble content after ISOT (Indiana Stirring Oxidation Test) (150° C., 96 hours) is 0.1 wt % or less].

Under such circumstances, the present invention has been intended, and an object of the present invention is to provide a lubricating oil composition for a high-speed gear which has a sufficient hypoid gear performance, can inhibit the formation of a sludge, and permits the prolongation of the life of an oil seal member for use in a high-speed and/or a high-temperature rotating portion.

Disclosure of the Invention

The present inventor has intensively researched with the intention of developing a lubricating oil composition for a high-speed gear having the above-mentioned preferable characteristics. As a result, it has been found that the above-mentioned object can be attained by blending a specific base oil having a % $C_A$ of 5 or less with three components of a sulfur additive, a phosphorus additive and a nitrogen additive in a predetermined ratio. In consequence, the present invention has been completed on the basis of this knowledge.

That is to say, the present invention is directed to (1) a lubricating oil composition for a high-speed gear which is obtained by blending a base oil having a % $C_A$ of 5 or less with a sulfur additive, a phosphorus additive and a nitrogen additive so that an element ratio 100N/(S+P) in the composition may be in the range of 4 to 10 by weight, (2) a lubricating oil composition for a high-speed gear which is obtained by blending a base oil having a % $C_A$ of 5 or less and having a nitrogen content of 50 ppm or less and a sulfur content of 50 ppm or less with a sulfur additive, a phosphorus additive and a nitrogen additive so that an element ratio 100N/(S+P) in the composition may be in the range of 4 to 10 by weight, (3) a lubricating oil composition for a high-speed gear which is obtained by blending a base oil having a % $C_A$ of 5 or less with a sulfur additive, a phosphorus additive and a nitrogen additive so that an element ratio 100N/(S+P) in the additives may be in the range of 4 to 10 by weight, and (4) a lubricating oil composition for a high-speed gear which is obtained by blending a base oil having a % $C_A$ of 5 or less and having a nitrogen content of 50 ppm or less and a sulfur content of 50 ppm or less with a sulfur additive, a phosphorus additive and a nitrogen additive so that an element ratio 100N/(S+P) in the additives may be in the range of 4 to 10 by weight.

In a lubricating oil composition of the present invention, a base oil having a %$C_A$ of 5 or less, preferably 3 or less is used. If this %$C_A$ is in excess of 5, an oxidative stability deteriorates and the formation of a sludge increases. Furthermore, the base oil suitably has a kinematic viscosity of 2 to 50 cSt, preferably 2 to 30 cSt at a temperature of 100° C. In this connection, the % $C_A$ is a value measured by an ndM method.

As such a base oil, various oils can be used irrespective of mineral oils and synthetic oils, and no particular restriction is put on the kind of base oil. A typical example of the mineral oil is a refined oil which can be obtained by first distilling a paraffinic crude oil, an intermediate crude oil or a naphthenic crude oil under atmospheric pressure, or distilling a residual oil of the atmospheric distillation under reduced pressure to obtain a distilled oil, and then refining the distilled oil in a usual manner. In particular, it is preferred to use a hydrotreated mineral oil. The nitrogen content in the mineral oil is preferably 150 ppm or less, more preferably 100 ppm or less, most preferably 50 ppm or less, and the sulfur content in the mineral oil is preferably 250 ppm or less, more preferably 100 ppm or less, most preferably 50 ppm or less. In the present invention, even if the base oil is the mineral oil having a low refining-degree, i.e., the mineral oil having a relatively high nitrogen content and sulfur content, the effect of the present invention can effectively be exerted, but when the nitrogen content and the sulfur content in the base oil to be used are within the above-mentioned ranges, the obtained lubricating oil composition is excellent in the oxidative stability and hence the desired effect can be obtained. On the other hand, examples of the synthetic oil include polymers and copolymers of olefins, dibasic acid esters, polyglycols, hindered esters and alkylbenzenes. As the base oil, the mineral oils and the olefin polymers of c-olefins and the like are preferable. In the present invention, the mineral oils and the synthetic oils may be used singly or in a combination of two or more thereof.

No particular restriction is put on the sulfur additive which can be blended with the base oil, and the sulfur additives which have usually been used in gear oils can be employed in the present invention. Typical examples of the sulfur additive include olefin sulfides, polysulfides, sulfurized fats and oils, sulfurized mineral oils, thiophosphoric acid compounds, thiocarbamate compounds, thiocarbonate compounds, sulfoxides and thiol sulfinates. Above all, the olefin sulfides and the polysulfides are preferable.

The above-mentioned sulfur additives may be used singly or in a combination of two or more thereof. The amount of the sulfur additive to be blended is in the range of 0.2 to 4 wt %, preferably 0.5 to 3 wt % in terms of sulfur based on the total weight of the composition. If the amount of the sulfur additive is less than 0.2 wt %, a hypoid gear performance (extreme-pressure properties) is poor, and if it is more than 4 wt %, the hypoid gear performance cannot correspondingly be improved, and inversely, there is a tendency that the formation of the sludge increases.

No particular restriction is put on the phosphorus additive which can be blended with the base oil, and the phosphorus additives which have usually been used in the gear oils can be employed in the present invention. Typical examples of the phosphorus additive include acid phosphates, hydrogenphosphites, phosphites, phosphates, amine salts of these compounds, phosphonates, phosphinates and phosphoroamidates. Above all, the acid phosphates and their amine salts are preferable.

The above-mentioned phosphorus additives may be used singly or in a combination of two or more thereof. The amount of the phosphorus additive to be blended is in the range of 0.01 to 0.3 wt %, preferably 0.04 to 0.2 wt % in terms of phosphorus based on the total weight of the composition. If the amount of the phosphorus additive is less than 0.01 wt %, the effect of the present invention cannot be sufficiently exerted, and if it is more than 0.3 wt %, the effect cannot correspondingly be improved, and inversely, there is a tendency that the extreme-pressure properties deteriorate.

On the other hand, no particular restriction is put on the nitrogen additive which can be blended with the base oil, and nitrogen-containing dispersants and nitrogen-containing antioxidants which have usually been used in lubricating oils can be employed in the present invention. Typical examples of the nitrogen-containing dispersants include alkylsuccinimides, alkenylsuccinimides, boron-containing alkylsuccinimides and boron-containing alkenylsuccinimides, benzylamine compounds (Mannich bases), polybutenylamines, succinic acid ester compounds and acid amides, and above all, the alkylsuccinimides, the alkenylsuccinimides, the boron-containing alkylsuccinimides and the boron-containing alkenylsuccinimides are preferable. In particular, the boron-containing alkylsuccinimides and the boron-containing alkenylsuccinimides are preferable. Furthermore, typical examples of the nitrogen-containing antioxidants include diphenylamines, alkylated diphenylamines and phenyl-α-naphthylamines.

In the present invention, as the nitrogen additive, the nitrogen-containing dispersants may be used singly or in a combination of two or more thereof, or the nitrogen-containing antioxidants may be used singly or in a combination of two or more thereof. Alternatively, one or more of the nitrogen-containing dispersants and one or more of the nitrogen-containing antioxidants may be used in combination.

The amount of the nitrogen additive to be blended is in the range of 0.02 to 0.3 wt %, preferably 0.05 to 0.15 wt % in terms of nitrogen based on the total weight of the composition. If the amount of the nitrogen additive is less than 0.02 wt %, the effect of the present invention cannot be sufficiently exerted, and if it is more than 0.3 wt %, the effect cannot correspondingly be improved, and inversely, there is a tendency that the extreme-pressure properties deteriorate.

In the lubricating oil composition of the present invention, an element ratio 100N/(S+P) is required to be in the range of 4 to 10, preferably 5 to 8 by weight. If this element ratio is less than 4, the prevention effect of the sludge formation cannot sufficiently be exerted. On the other hand, if it is more than 10, the hypoid gear performance deteriorates, so that a damage such as scouring occurs.

The nitrogen content in the composition is mainly derived from the nitrogen-containing dispersant and the nitrogen-containing antioxidant, but in consideration of the sludge prevention performance, it is preferable that the nitrogen content derived from the nitrogen-containing dispersant is higher than that derived from the nitrogen-containing antioxidant.

As described above, the lubricating oil composition of the present invention can be obtained by blending the sulfur additive, the phosphorus additive and the nitrogen additive with the base oil having a % $C_A$ of 5 or less and preferably having a nitrogen content of 50 ppm or less and a sulfur content of 50 ppm or less so that the element ratio 100N/(S+P) in the additives may be in the range of 4 to 10, preferably 5 to 8 by weight.

If necessary, the lubricating oil composition of the present invention can suitably be blended with various additives, and examples of the additives include antioxidants such as phenol compounds and ZnDTP, detergent-dispersants such as calcium sulfonate, magnesium sulfonate, barium sulfonate, calcium phenate and barium phenate, viscosity index improvers such as polymethacrylates, polyisobutylenes, ethylene-propylene copolymers and styrene-butadiene hydrogenated copolymers, antifoamers such as dimethyl polysiloxanes and polyacrylates, pour point depressants, anti-corrosive agents and rust preventives. In this case, it is desirable from the viewpoint of seal durability improvement to select the amounts of the additives so that the contents of metallic elements of calcium, zinc and the like may not exceed 0.10 wt % based on the weight of the lubricating oil composition.

The lubricating oil composition of the present invention can particularly be used as a gear oil for a transmission which is equipped with a high-speed rotating shaft having a peripheral speed of 10 m/sec or more and which will suffer a high speed and/or a high temperature, and the composition is also useful as a gear oil for a superhigh-speed transmission having a peripheral speed of more than 20 m/sec.

BEST MODE FOR CARRYING OUT THE INVENTION

Next, the present invention will be described in more detail with reference to examples, but the scope of the present invention should not be limited to these examples.

EXAMPLES 1 TO 3 AND COMPARATIVE EXAMPLES 1 TO 4

Lubricating oil compositions shown in Table 1 were prepared, and their performances were then evaluated. The results are shown in Table 1.

TABLE 1

| | Example | | |
|---|---|---|---|
| | 1 | 2 | 3 |
| Additives for Lubricating Oil (wt %) | | | |
| Base oil: | | | |
| Hydrotreated mineral oil | | | |
| N: 5 ppm or less, S: 5 ppm or less | 91.04 | — | 90.34 |
| N: 12 ppm, S: 5 ppm or less | — | 91.04 | — |
| Kinematic viscosity (cSt: 100° C.) | 11.6 | 10.9 | 11.6 |
| S components: | | | |
| Olefin sulfide*1 | 2.1 | 2.1 | 2.1 |
| Polysulfide*2 | 1.6 | 1.6 | 1.6 |
| P components: | | | |
| Acid phosphate*3 | 1.4 | 1.4 | 1.0 |
| Amine salt of phosphate*4 | — | — | 0.5 |

TABLE 1-continued

| | | | |
|---|---|---|---|
| N components: | | | |
| Dispersant | | | |
| Boron-containing polybutenylsuccinimide*5 | 3.5 | 3.5 | 2.6 |
| Polybutenylsuccinimide*6 | — | — | 1.5 |
| Antioxidant | | | |
| Phenyl-α-naphthylamine*7 | 0.3 | 0.3 | 0.3 |
| Other additives*8 | 0.06 | 0.06 | 0.06 |
| Lubricating oil composition | | | |
| Base oil (% $C_A$)*9 | 0.1> | 4.3 | 0.1> |
| S content (wt %) | 1.59 | 1.59 | 1.59 |
| P content (wt %) | 0.08 | 0.08 | 0.08 |
| N content (wt %) | 0.09 | 0.09 | 0.12 |
| Element ratio 100N/(S + P) (by weight) | 5.4 | 5.4 | 7.2 |
| Evaluation | | | |
| After ISOT | | | |
| n-pentane-insoluble content*10 (wt %) | 0.1> | 0.1> | 0.1> |
| Lacquer degree (presence/absence of deposit) | Absent | Slightly present | Absent |
| Hypoid gear performance*11 | Pass | Pass | Pass |
| Seal durability*12 (hr) | 3500 | 3000 | 3000 |

| | Comparative Example | | | |
|---|---|---|---|---|
| | 1 | 2 | 3 | 4 |
| Additives for Lubricating Oil (wt %) | | | | |
| Base oil: | | | | |
| Hydrotreated mineral oil | | | | |
| N: 5 ppm or less, S: 5 ppm or less | 90.79 | — | — | — |
| N: 10 ppm, S: 5 ppm or less | — | — | 90.69 | — |
| N: 34 ppm, S: 20 ppm | — | 90.79 | — | 91.04 |
| Kinematic viscosity (cSt: 100° C.) | 11.6 | 12.1 | 10.5 | 12.1 |
| S components: | | | | |
| Olefin sulfide*1 | 2.9 | 2.9 | 1.2 | 2.1 |
| Polysulfide*2 | 1.45 | 1.45 | 1.45 | 1.6 |
| P components: | | | | |
| Acid phosphate*3 | 2.0 | 2.0 | 1.0 | 1.4 |
| Amine salt of phosphate*4 | — | — | 0.5 | — |
| N components: | | | | |
| Dispersant | | | | |
| Boron-containing polybutenylsuccinimide*5 | 2.5 | 2.5 | 3.3 | 3.5 |
| Polybutenylsuccinimide*6 | — | — | 1.5 | — |
| Antioxidant | | | | |
| Phenyl-α-naphthylamine*7 | 0.3 | 0.3 | 0.3 | 0.3 |
| Other additives*8 | 0.06 | 0.06 | 0.06 | 0.06 |
| Lubricating oil composition | | | | |
| Base oil (% $C_A$)*9 | 0.1> | 7.4 | 3.1 | 7.4 |
| S content (wt %) | 1.90 | 1.90 | 1.12 | 1.59 |
| P content (wt %) | 0.11 | 0.11 | 0.08 | 0.08 |
| N content (wt %) | 0.07 | 0.07 | 0.13 | 0.09 |
| Element ratio 100N/(S + P) (by weight) | 3.5 | 3.5 | 11 | 5.4 |
| Evaluation | | | | |
| After ISOT | | | | |
| n-pentane-insoluble content*10 (wt %) | 0.7 | 1.7 | 0.1> | 1.2 |
| Lacquer degree (presence/absence of deposit) | Present | Present | Present | Present |
| Hypoid gear performance*11 | Pass | Pass | NG | Pass |
| Seal durability*12 (hr) | 500> | 500> | 1500 | 500> |

*1Olefin sulfide (S: 46 wt %)
*2Polysulfide (S: 39 wt %)
*3Acid phosphate (P: 5.7 wt %)
*4Amine salt of phosphate (P: 4.5 wt %, N: 2.8 wt %)

TABLE 1-continued

*5Boron-containing polybutenylsuccinimide (N: 2.0 wt %, B: 1.7 wt %)
*6Polybutenylsuccinimide (N: 2.0 wt %)
*7Phenyl-α-naphthylamine (N: 6.4 wt %)
*8Other additives: A pour point depressant and an antifoamer
*9This was measured in accordance with the ndM method.
*10ISOT (Indiana Stirring Oxidation Test) was carried out at a temperature of 150° C. for 96 hours in accordance with JIS K2514-3.1, and after the test, an n-pentane-insoluble content in the sample was measured in accordance with the B method of ASTM D 893.
*11This was evaluated by the high speed-shock loading axle test of CRC L42.
*12This was evaluated on the basis of a time taken until the occurrence of oil leakage by the durability test of an oil seal (eccentricity of shaft: 0.2 mm TIR, peripheral speed of shaft: 30 m/sec).

As is apparent from the results in Table 1, the compositions having a good performance can be obtained by setting the % $C_A$ of the base oil to 5 or less, combining the three components of S, P and N and setting the element ratio 100N/(S+P) (by weight) in the range of 4 to 10, and in the thus obtained compositions, the oxidative stability (which is evaluated on the basis of the n-pentane-insoluble content after the ISOT), the hypoid gear performance (extreme-pressure properties) and the seal durability are all excellent (Examples 1, 2 and 3).

When the % $C_A$ of the base oil is 5 or less and the element ratio 100N/(S+P) is less than 4, the sufficient performance cannot be obtained, and hence the formation of the sludge increases (which is evaluated on the basis of the n-pentane-insoluble content after the ISOT) and the seal durability is poor (Comparative Example 1).

In addition, when the % $C_A$ of the base oil is more than 5, the formation of the sludge further increases, and the seal durability is also poor. Hence, the sufficient performance cannot be obtained (Comparative Examples 2 and 4).

On the other hand, when the element ratio 100N/(S+P) is more than 10, the hypoid gear performance is insufficient, and hence the performance which the oil for a high-speed gear should have cannot be obtained (Comparative Example 3).

Possibility of Industrial Utilization

A lubricating oil composition of the present invention has a sufficient hypoid gear performance, can inhibit the formation of a sludge, and permits the prolongation of the life of an oil seal for use in a high-speed and/or a high-temperature rotating portion. In particular, the composition can be used as a gear oil for a transmission which is equipped with a high-speed rotating shaft having a peripheral speed of 10 m/sec or more, and the composition is also useful as a gear oil for a superhigh-speed transmission having a peripheral speed of more than 20 m/sec. For example, the lubricating oil composition can suitably be used as a gear oil for a high-speed running vehicle and an industrial gear oil.

I claim:

1. A lubricating oil composition for a high-speed gear which is obtained by blending a base oil having a % $C_A$ of 5 or less with a sulfur additive, a phosphorus additive and a nitrogen additive so that an element ratio 100N/(S+P) in the composition is in the range of 4 to 10 by weight, said oil composition being capable of being used for a high-speed gear having a peripheral speed of at least 10 m/sec.

2. A lubricating oil composition for a high-speed gear which is obtained by blending a base oil having a % $C_A$ of 5 or less and having a nitrogen content of 50 ppm or less and a sulfur content of 50 ppm or less with a sulfur additive, a phosphorus additive and a nitrogen additive so that an element ratio 100N/(S+P) in the composition is in the range of 4 to 10 by weight.

3. A lubricating oil composition for a high-speed gear which is obtained by blending a base oil having a % $C_A$ of 5 or less with a sulfur additive, a phosphorus additive and a nitrogen additive so that an element ratio 100N/(S+P) in the additives is in the range of 4 to 10 by weight.

4. A lubricating oil composition for a high-speed gear which is obtained by blending a base oil having a % $C_A$ of 5 or less and having a nitrogen content of 50 ppm or less and a sulfur content of 50 ppm or less with a sulfur additive, a phosphorus additive and a nitrogen additive so that an element ratio 100N/(S+P) in the additives is in the range of 4 to 10 by weight.

5. The lubricating oil composition for a high-speed gear according to claim 1 wherein the base oil is a hydrotreated mineral oil.

6. The lubricating oil composition for a high-speed gear according to claim 1 wherein the % $C_A$ of the base oil is 3 or less.

7. The lubricating oil composition for a high-speed gear according to claim 1 wherein the kinematic viscosity of the base oil at 100° C. is in the range of 2 to 50 cSt.

8. The lubricating oil composition for a high-speed gear according to claim 1 wherein the sulfur additive is an olefin sulfide or a polysulfide.

9. The lubricating oil composition for a high-speed gear according to claim 1 wherein the sulfur additive is blended in an amount of 0.2 to 4 wt % in terms of sulfur.

10. The lubricating oil composition for a high-speed gear according to claim 1 wherein the phosphorus additive is an acid phosphate or its amine salt.

11. The lubricating oil composition for a high-speed gear according to claim 1 wherein the phosphorus additive is blended in an amount of 0.01 to 0.3 wt % in terms of phosphorus.

12. The lubricating oil composition for a high-speed gear according to claim 1 wherein the nitrogen additive is an alkylsuccinimide, an alkenylsuccinimide, a boron-containing alkylsuccinimide or a boron-containing alkenylsuccinimide.

13. The lubricating oil composition for a high-speed gear according to claim 1 wherein the nitrogen additive is blended in an amount of 0.02 to 0.3 wt % in terms of nitrogen.

14. The lubricating oil composition for a high-speed gear according to claim 1 wherein the element ratio 100N/(S+P) in the composition is in the range of 5 to 8 by weight.

15. A superhigh-speed transmission oil composition for a high-speed gear having a peripheral speed of more than 20 m/sec, the oil composition comprising the oil composition of claim 1.

16. The lubricating oil composition for a high-speed gear according to claim 1 wherein the base oil has a nitrogen content of at most 150 ppm and a sulfur content of at most 250 ppm.

17. The lubricating oil composition for a high-speed gear according to claim 1 wherein the nitrogen additive is selected from the group consisting of nitrogen-containing dispersants and nitrogen-containing antioxidants.

18. The lubricating oil composition for a high-speed gear according to claim 17 wherein nitrogen content derived from the nitrogen-containing dispersants is greater than nitrogen content derived from the nitrogen-containing antioxidants.

19. The lubricating oil composition for a high-speed gear according to claim 1 wherein said element ratio in the composition is in the range of 5.4 to 7.2 by weight.

* * * * *